US010267108B2

(12) United States Patent
Genovese et al.

(10) Patent No.: US 10,267,108 B2
(45) Date of Patent: Apr. 23, 2019

(54) PLUG LAUNCHING SYSTEM AND METHOD

(71) Applicant: Nabors Drilling Technologies USA, Inc., Houston, TX (US)

(72) Inventors: Cory Genovese, Calgary (CA); Farzan Tavakoli, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 15/634,945

(22) Filed: Jun. 27, 2017

(65) Prior Publication Data

US 2017/0370169 A1 Dec. 28, 2017

Related U.S. Application Data

(60) Provisional application No. 62/355,798, filed on Jun. 28, 2016.

(51) Int. Cl.

| | |
|---|---|
| ***E21B 23/08*** | (2006.01) |
| ***E21B 33/12*** | (2006.01) |
| ***E21B 33/14*** | (2006.01) |
| ***E21B 37/00*** | (2006.01) |
| ***E21B 33/05*** | (2006.01) |
| ***E21B 33/068*** | (2006.01) |
| ***E21B 33/16*** | (2006.01) |

(52) U.S. Cl.

CPC ..... *E21B 23/08* (2013.01); *E21B 33/05* (2013.01); *E21B 33/068* (2013.01); *E21B 33/12* (2013.01); *E21B 33/14* (2013.01); *E21B 33/16* (2013.01); *E21B 37/00* (2013.01)

(58) Field of Classification Search

CPC ..... E21B 23/08; E21B 33/05; E21B 33/068; E21B 33/12; E21B 33/14; E21B 33/16; E21B 37/00

See application file for complete search history.

(56) References Cited

U.S. PATENT DOCUMENTS

| | | | |
|---|---|---|---|
| 5,890,537 | A | 4/1999 | Lavaure et al. |
| 2004/0055741 | A1 | 3/2004 | Pedersen et al. |
| 2011/0232923 | A1 | 9/2011 | Barbee et al. |

OTHER PUBLICATIONS

PCT/US2017/039813 International Search Report & Written Opinion for International dated Sep. 18, 2017.

*Primary Examiner* — D. Andrews
*Assistant Examiner* — Yanick A Akaragwe
(74) *Attorney, Agent, or Firm* — Abel Schillinger, LLP; Enrique Abarca

(57) ABSTRACT

A plug launching system includes a main body and a plug canister disposed within the main body. The plug canister includes a liner, a first rotational assembly disposed about the liner, wherein the first rotational assembly is configured to support a first plug disposed within the liner and selectively enable fluid flow from an annulus between the main body and the plug canister to a central passage of the liner, and a second rotational assembly disposed about the liner, wherein the second rotational assembly is configured to support a second plug disposed within the liner and selectively enable fluid flow from the annulus between the main body and the plug canister to the central passage of the liner, wherein the first and second rotational assemblies are configured to be actuated independently from one another.

20 Claims, 7 Drawing Sheets

PLUG LAUNCHING SYSTEM AND METHOD

CROSS REFERENCE TO RELATED APPLICATION

This application claims priority to and benefit of U.S. Provisional Application No. 62/355,798, entitled "ROTARY SLEEVE PLUG LAUNCHING SYSTEM," filed Jun. 28, 2016, which is hereby incorporated by reference in its entirety.

BACKGROUND

Embodiments of the present disclosure relate generally to the field of drilling and processing of wells. More particularly, present embodiments relate to a system and method for launching cement plugs during casing operations.

Cement plugs are typically utilized during casing operations to substantially remove cement from an interior surface of wellbore tubulars. In conventional oil and gas operations, an annulus is formed around the wellbore tubulars within a formation. During completion operations, casing (e.g., wellbore tubulars) may be secured to the formation via cementing. The cement is pumped through the casing to fill the annulus and secure the casing to the formation. After cement pumping is complete, the cement plug is introduced into the casing to clear the cement from the interior surface of the casing. As a result, cementing operations may continue with little to no mixing of cement with the drilling/displacement fluids pumped through the casing.

BRIEF DESCRIPTION

In accordance with one aspect of the disclosure, a plug launching system includes a main body and a plug canister disposed within the main body. The plug canister includes a liner, a first rotational assembly disposed about the liner, wherein the first rotational assembly is configured to support a first plug disposed within the liner and selectively enable fluid flow from an annulus between the main body and the plug canister to a central passage of the liner, and a second rotational assembly disposed about the liner, wherein the second rotational assembly is configured to support a second plug disposed within the liner and selectively enable fluid flow from the annulus between the main body and the plug canister to the central passage of the liner, wherein the first and second rotational assemblies are configured to be actuated independently from one another.

In accordance with another aspect of the disclosure, a method includes a directing a cement flow through an annulus between a plug canister and a main body of a plug launching system, directing the cement flow from the annulus to a central passage of the plug canister through a first plurality of openings extending through the plug canister, wherein the first plurality of openings are disposed axially below a first plug disposed within the plug canister, directing the cement flow from the central passage into a casing string disposed within a wellbore, rotating a first rotary sleeve of the plug canister to occlude the first plurality of openings, and re-directing the cement flow from the annulus to the central passage of the plug canister through a second plurality of openings extending through the plug canister, wherein the second plurality of openings are disposed axially above the first plug.

In accordance with another aspect of the disclosure, a plug launching system includes a plug canister having a liner comprising a first plurality of openings and a second plurality of openings, a first rotary sleeve disposed about the liner, wherein the first rotary sleeve is configured selectively enable fluid flow through the first plurality of openings to a central passage of the liner, a first door assembly disposed adjacent to the first rotary sleeve, wherein the first door assembly comprises a first plurality of doors pivotably coupled to a first main ring of the first door assembly, a second rotary sleeve disposed about the liner, wherein the second rotary sleeve is configured selectively enable fluid flow through the second plurality of openings to the central passage of the liner, and a second door assembly disposed adjacent to the second rotary sleeve, wherein the second door assembly comprises a second plurality of doors pivotably coupled to a second main ring of the second door assembly, wherein the first rotary sleeve and the second rotary sleeve are each rotatable relative to the liner, and wherein the first main ring of the first door assembly and the second main ring of the second door assembly are rotationally fixed relative to the liner.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Present embodiments provide a system and method for launching one or more cement plugs or darts within a casing or other tubular. During casing cementing operations, a plug (e.g., rubber plug) is used to separate cement from displacement fluid as the plug is launched to substantially remove cement from an interior surface of wellbore tubulars (e.g., casing). In certain embodiments, a plug launching system includes two or more plugs to be individually launched down a string of casing or tubular. As a result, the disclosed plug launching system may be used for multi-stage cementing operations.

Before cement is pumped into the casing, the plug launching system may be coupled between the casing string and a cementing process component, such as a cement swivel. As described in detail below, cement may be pumped through the plug launching system into the casing. After a desired amount (e.g., a first stage amount) of cement is pumped into the casing or tubular, the plug launching system may be actuated to direct the cement flow behind a first plug of plug launching system to launch the first plug down the casing or tubular string. Specifically, actuation of the plug launching system may re-direct cement flow passing through the plug launching system to flow behind the first plug to launch the first plug down the casing string. Thereafter, cement may be pumped through the plug launching system again to complete a second stage cementing process. After a desired amount (e.g., a second stage amount) of cement is pumped into the casing or tubular, the plug launching system may be actuated to direct the cement flow behind a second plug of plug launching system to launch the second plug down the casing or tubular string. Although the embodiments of the plug launching system described below include two plug stages, other embodiments may include one, three, four, five, or more plug stages using techniques similar to those described herein.

Figure 1:
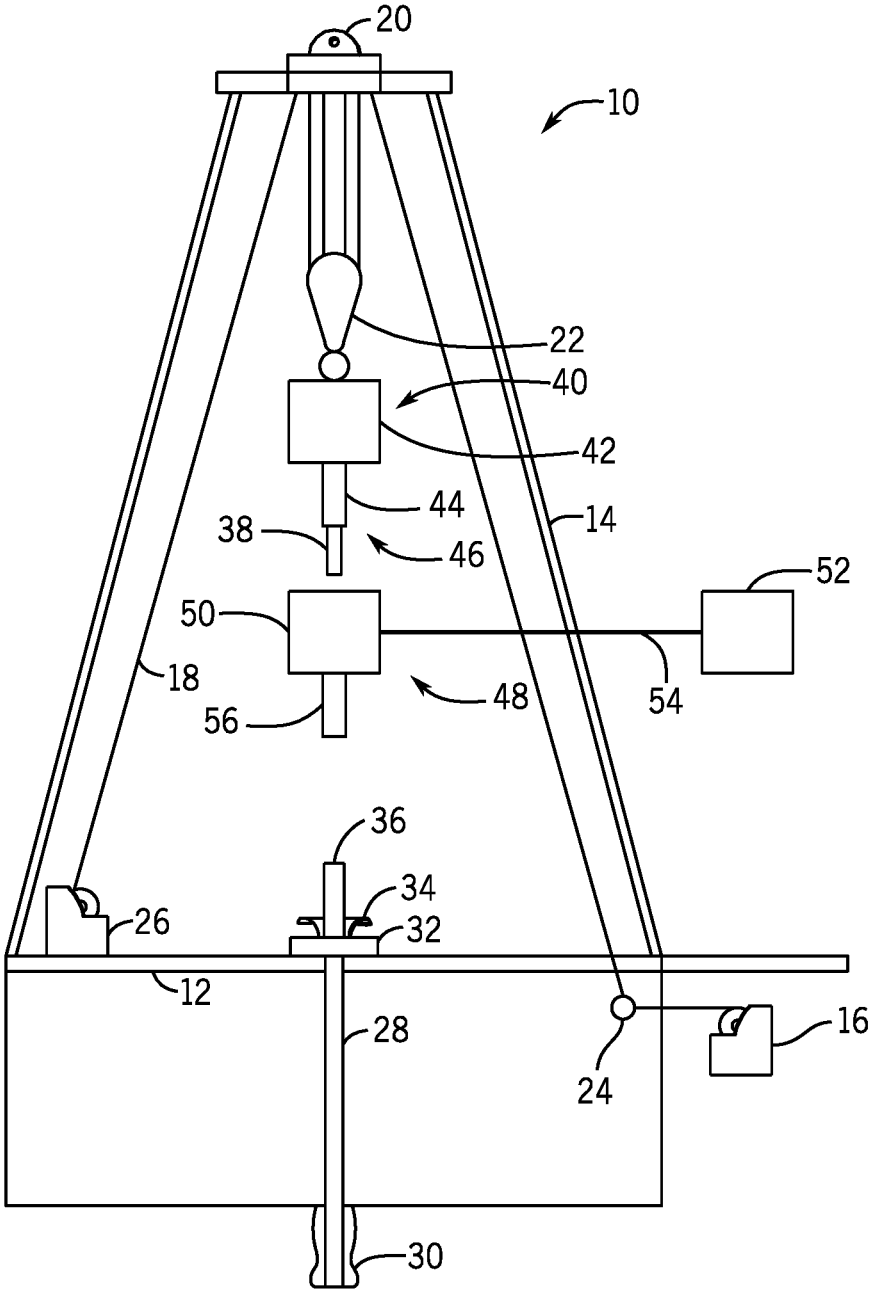
FIG. 1 is a schematic of an embodiment of a well being drilled with a plug launching system, in accordance with present techniques.

Turning now to the drawings, FIG. 1 is a schematic view of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a casing string 28 extends downward into a wellbore 30 and is held stationary with respect to the rig floor 12 by a rotary table 32 and slips 34 (e.g., power slips). A portion of the casing string 28 extends above the rig floor 12, forming a stump 36 to which another length of tubular 38 (e.g., a section of casing) may be added.

A tubular drive system 40, hoisted by the traveling block 22, positions the tubular 38 above the wellbore 30. In the illustrated embodiment, the tubular drive system 40 includes a top drive 42 and a gripping device 44. The gripping device 44 of the tubular drive system 40 is engaged with a distal end 46 (e.g., box end) of the tubular 38. The tubular drive system 40, once coupled with the tubular 38, may then lower the coupled tubular 38 toward the stump 36 and rotate the tubular 38 such that it connects with the stump 36 and becomes part of the casing string 28. The casing string 28 (and the tubular 38 now coupled to the casing string 28) may then be lowered (and rotated) further into the wellbore 30.

In the illustrated embodiment, the drilling rig 10 also includes a cementing system 48. The cementing system 48 is used during cementing operations to direct cement into the casing string 28. In the illustrated embodiment, the cementing system 48 includes a cement swivel 50 configured to supply cement for cementing operations. For example, the cement swivel 50 may receive cement from a pumping unit 52 via a supply line 54. Additionally, the cementing system 48 includes a plug launching system 56 configured to direct the cement from the cement swivel 50 into the casing string 28. To this end, the plug launching system 56 may be coupled (e.g., threaded) to the cement swivel 50 and the casing string 28 (e.g., the stump 36 of the casing string 28).

In certain embodiments, the cementing system 48 may also use a casing drive system configured reciprocate and/or rotate the tubular 38 (e.g., casing) may be used during casing and/or cementing operations. For example, the casing drive system may be placed above the rig floor 12 or may be placed beneath the rig floor 12, at the rig floor 12, within the wellbore 30, or any other suitable location on the drilling rig 10 to enable rotation of the tubular 38 during casing and/or cementing operations. In embodiments where a casing drive system is used, the plug launching system 56 may be coupled to the casing drive system instead of the cement swivel 50.

As mentioned above, cement is pumped through the plug launching system 56 into the casing string 28. After a desired amount of cement is pumped into the casing string 28, such as an amount of cement to secure a first stage of the casing string 28 within the wellbore 30, the plug launching system 56 may be actuated to direct the cement flow behind a first plug of plug launching system 56 to launch the first plug down the casing string 28. Specifically, in the manner described below, actuation of the plug launching system 56 re-directs cement flow passing through the plug launching system 56 to flow behind the first plug to launch the first plug down the casing string 28. Thereafter, cement may be pumped through the plug launching system 56 and into the casing string 28 again. After a second desired amount of cement is pumped into the casing string 28, such as an amount of cement to secure a second stage of the casing string 28 within the wellbore 30, the plug launching system 56 may be actuated to direct the cement flow behind a second plug of plug launching system 56 to launch the second plug down the casing string 28. Actuation and operation of the plug launching system 56 is described in further detail below.

It should be noted that the illustration of FIG. 1 is intentionally simplified to focus on the plug launching system 56 of the drilling rig 10. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform. While only certain features of the disclosure have been illustrated and described herein, many modifications and changes will occur to those skilled in the art. It is, therefore, to be understood that the appended claims are intended to cover all such modifications and changes as fall within the true spirit of the disclosure.

Figure 2:
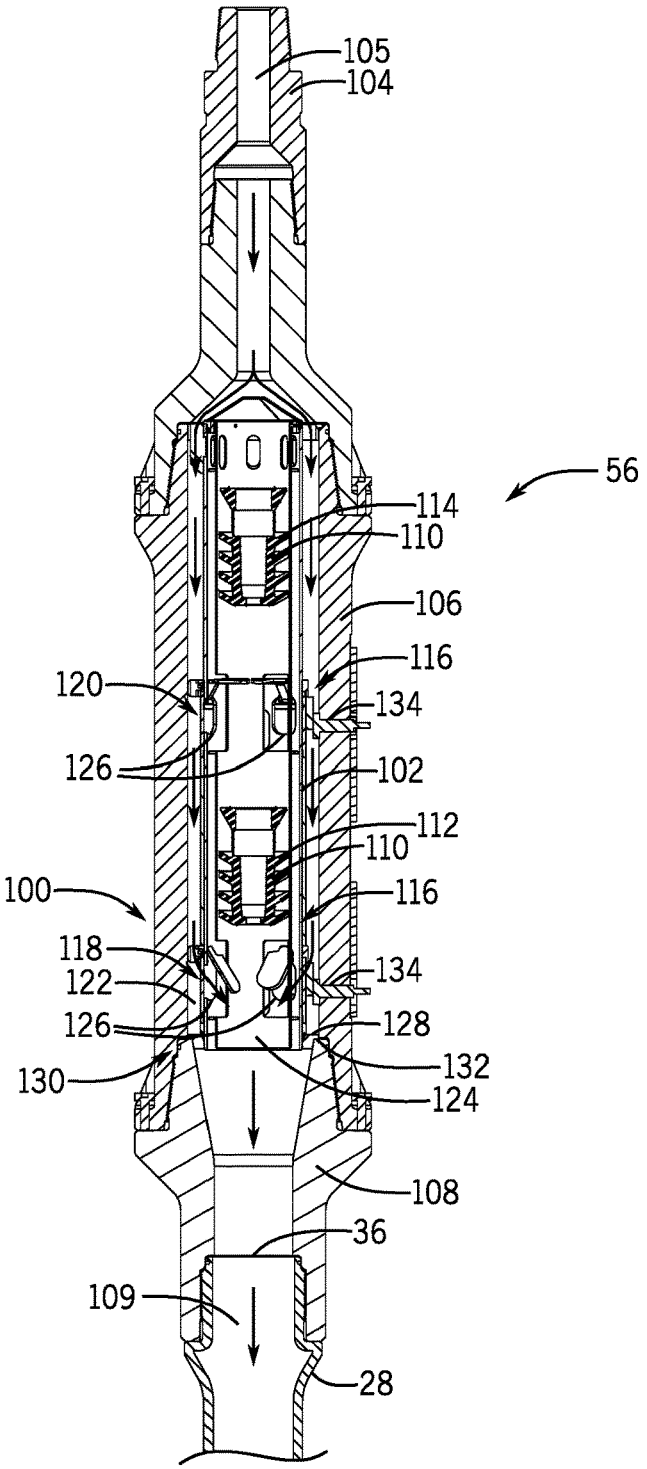
FIG. 2 is a cross-sectional side view of an embodiment of a plug launching system, in accordance with present techniques.

FIG. 2 is a cross-sectional side view of an embodiment of the plug launching system 56. The plug launching system 56 includes a body 100 and a canister 102 (e.g., a plug canister) disposed within the body 100. The body 100 includes an upper portion 104 having a central passage 105 (e.g., cement passage), a middle portion 106, and a lower portion 108 having a central passage 109 (e.g., cement passage). As shown, the upper portion 104 is coupled (e.g., threaded) to the middle portion 106, and the middle portion 106 is coupled (e.g., threaded) to the lower portion 108. The upper portion 104 may also couple (e.g., thread) to the cement swivel 50, a casing drive system, or other component used during the cementing process. The lower portion 108 is coupled (e.g., threaded) to the casing string 28 (e.g., the stump 36 of the casing string 28).

The canister 102 disposed within the body 100 is configured to house and support one or more cement plugs 110 (e.g., plug or dart). In the illustrated embodiment, the canister 102 houses and supports a first plug 112 (e.g., a lower plug) and a second plug 114 (e.g., an upper plug). However, other embodiments of the plug launching system 56 may house any suitable number of plugs 110. Each plug 110 is supported by a respective rotational assembly 116 of the plug launching system 56. Specifically, a first rotational assembly 118 supports the first plug 112, and a second rotational assembly 120 supports the second plug 114.

When the plug launching system 56 is connected to the casing string 28 and a cementing process begins, the rotational assemblies 116 are each in opened positions. In the opened position, each rotational assembly 116 blocks axial movement of the respective plug 110 that the rotational assembly 116 supports, in the manner described in detail below. Additionally, when the rotational assemblies 116 are in the opened position, cement may flow from the central passage 105, into an annulus 122 between the body 100 and the canister 102, and into a central passage 124 of the plug launching system 56. More specifically, cement may flow from the annulus 122 into the central passage 124 through respective openings 126 beneath the plugs 110. From the central passage 124, the cement may flow through the central passage 109 of the lower portion 108 and into the casing string 28. It should be noted that the plug launching system 56 includes a baffle plate 128 to block cement flow between the body 100 and the canister 102 at an axial end 130 of the canister 102. In the illustrated embodiment, the baffle plate 128 is coupled to the canister 102 and abuts a shoulder 132 of the lower portion 108 of the body 100. However, in other embodiments, the baffle plate 128 may have other configurations.

When one of the rotational assemblies 116 is actuated, the respective openings 126 of the actuated rotational assembly 116 are closed to block cement flow therethrough. Additionally, actuation of the rotational assembly 116 releases the respective cement plug 110 supported by the rotational assembly 116 to allow axial movement of the cement plug 110 (e.g., down the plug launching system 56 and into the casing string 28). To actuate the rotational assemblies 116, each rotational assembly 116 includes an actuation mechanism 134 that extends through the body 100 and engages with its respective rotational assembly 116. Details and operation of the rotational assemblies 116 are described in further detail below with respect to FIGS. 6-10.

Figure 5:
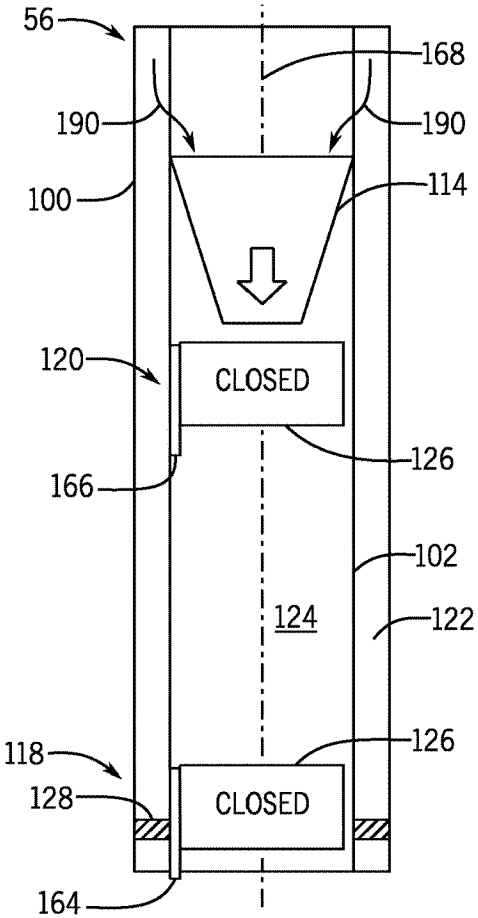
FIG. 5 is a schematic of an embodiment of a plug launching system, illustrating operation of the plug launching system, in accordance with present techniques.
Figure 4:
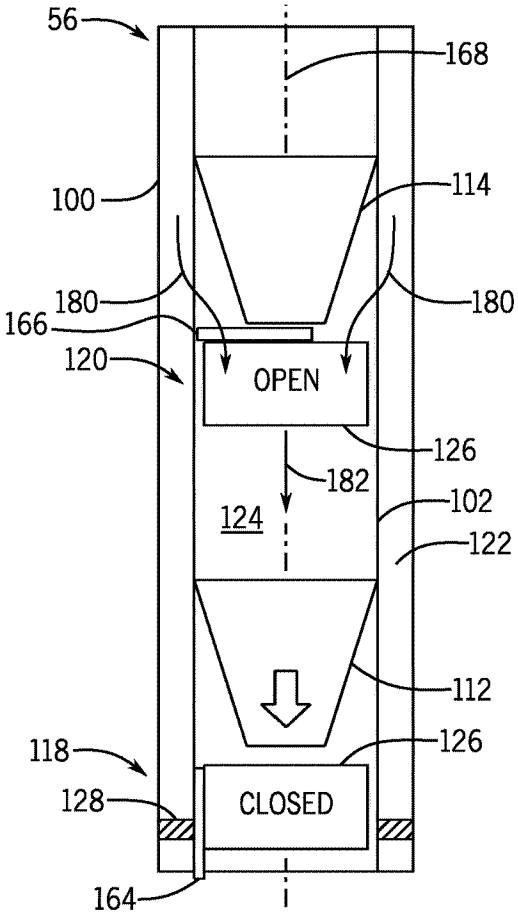
FIG. 4 is a schematic of an embodiment of a plug launching system, illustrating operation of the plug launching system, in accordance with present techniques.
Figure 3:
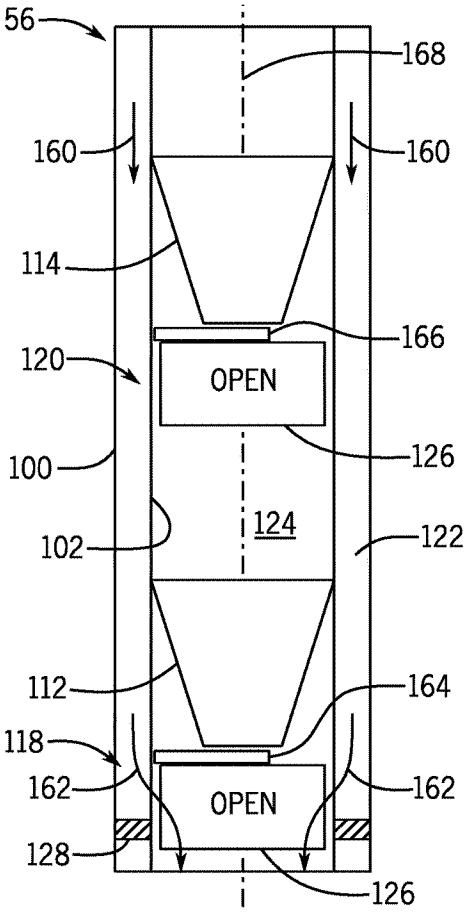
FIG. 3 is a schematic of an embodiment of a plug launching system, illustrating operation of the plug launching system, in accordance with present techniques.

FIGS. 3-5 are schematics of the plug launching system 56, illustrating cement flow through the plug launching system 56 when the first and second rotational assemblies 118 and 120 are in different positions (e.g., opened and closed positions). For example, FIG. 3 illustrates the plug launching system 56 when the first and second rotational assemblies 118 and 120 are each in the opened position. In the opened position, the respective openings 126 of the first and second rotational assemblies 118 and 120 are opened to enable cement flow from the annulus 122 between the body 100 and the canister 102 into the central passage 124 of the plug launching system 56. In the illustrated embodiment, arrows 160 indicate the cement flowing through the annulus 122 between the body 100 and the canister 102, and arrows 162 indicate the cement flowing through the openings 126 of the first rotational assembly 118. As mentioned above, the plug launching system 56 includes the baffle plate 128 to block cement flow between the body 100 and the canister 102 at the axial end 130 of the canister 102. A majority of the cement may flow through the annulus 122 and through the openings 126 of the first rotational assembly 118 (e.g., instead of through the openings 126 in the second rotational assembly 120, which are also opened) because such flow path may be the path of least resistance. For example, cement flow blocked by the baffle plate 128 may readily flow through the openings 126 of the first rotational assembly 118, which are axially below the openings 126 of the second rotational assembly 118.

As mentioned above, when the rotational assembly 116 is in the opened position, the rotational assembly 116 may block axial movement of the cement plug 110 that the rotational assembly 116 supports. For example, in the illustrated embodiment, the first rotational assembly 118 includes a door 164, and the second rotational assembly 120 includes a door 166. As shown in FIG. 3, when the first and second rotational assemblies 118 and 120 are each in the opened position, the doors 164 and 166, respectively, extend radially inward relative to a central axis 168 of the plug launching system 56. As a result, the door 164 blocks the axial (e.g., downward) movement of the first plug 112, and the door 166 blocks the axial (e.g., downward) movement of the second plug 114. In this manner, the positions of the first and second plugs 110 and 112 are maintained until plug 110 launching is desired. Actuation of the rotational assembly 116 enables the door (e.g., door 164 or 166) to drop (e.g., pivot downward) to thereby allow axial (e.g., downward) movement of the plug 110. Operation of the doors 164 and 166 is described in further detail below.

FIG. 4 illustrates the plug launching system 56 with the first rotational assembly 118 in the closed position and the second rotational assembly 120 in the opened position. In other words, the illustrated embodiment shows the plug launching system 56 after the first rotational assembly 118 has been actuated. With the first rotational assembly 118 actuated, the openings 126 of the first rotational assembly 118 are closed, and the door 164 of the first rotational assembly 118 has dropped to enable axial (e.g., downward) movement of the first plug 110.

With the openings 126 of the first rotational assembly 118 closed, the cement flow into the plug launching system 56 will fill the annulus 122 up to the openings 126 of the second rotational assembly 120. Thus, cement will flow through the openings 126 of the second rotational assembly 120, as indicated by arrows 180, as cement continues to be pumped into the plug launching system 56. The cement flowing through the openings 126 of the second rotational assembly 120 will enter the central passage 124 of the plug launching system 56 behind the first plug 112, as indicated by arrow 182. The cement head within the central passage 124 will increase and force (e.g., launch) the first plug 112 down the plug launching system 56 and into the casing string 28. After the first plug 112 is launched, displacement fluid or other fluid may be pumped into the casing string 28 (e.g., through the plug launching system 56) and/or a second cementing stage process may begin thereafter.

After a desired amount of cement (e.g., second stage cement) has been pumped into the casing string 28 and the wellbore 30, the second plug 120 may launched in a manner similar to that described above. For example, as shown in FIG. 5, the second rotational assembly 120 may be actuated to close the openings 126 of the second rotational assembly 120 and drop the door 166 of the second rotational assembly 120 to enable axial (e.g., downward) movement of the second plug 114. With the openings 126 of the second rotational assembly 120 closed, the cement flow into the plug launching system 56 will fill the annulus 122 above the second rotational assembly 120. As a result, cement will flow through openings (e.g., openings 228 and 230 shown in FIG. 6) formed in the canister 102 above the second plug 114, as indicated by arrows 190, as cement continues to be pumped into the plug launching system 56. The cement flowing through the openings of the canister 102 above the second plug 114 will enter the central passage 124 of the plug launching system 56 behind the second plug 114. The cement head above the second plug 114 will increase and force (e.g., launch) the second plug 114 down the plug launching system 56 and into the casing string 28.

Figure 6:
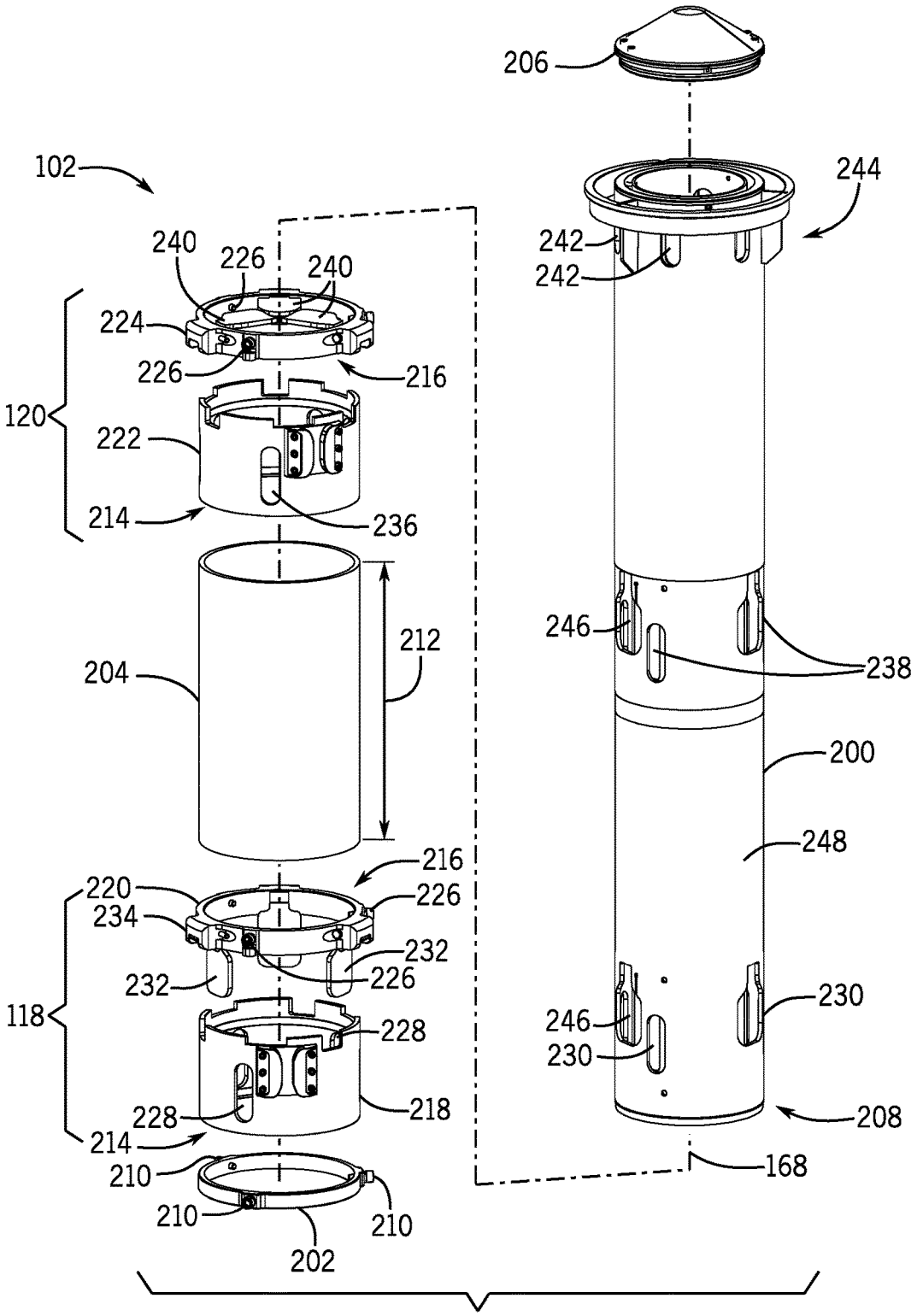
FIG. 6 is an exploded perspective view of an embodiment of a plug launching system, in accordance with present techniques.

FIG. 6 is an exploded perspective view of the canister 102 of the plug launching system 56. The canister 102 includes a liner 200 around which the first and second rotational assemblies 118 and 120 are positioned. The plugs 110 (e.g., first and second plugs 112 and 114) are positioned inside the liner 200 and are axially retained by the first and second rotational assemblies 118 and 120, respectively. In addition to the liner 200 and the first and second rotational assemblies 118 and 120, the canister 102 includes a retaining ring 202, a spacer sleeve 204, and a cap 206.

The retaining ring 202 is secured at an axial bottom or end 208 of the liner 200 and blocks axial (e.g., downward) movement of the first and second rotational assemblies 118 and 120 and the spacer sleeve 204 along the liner 200 when the canister 102 is installed within the body 100. The retaining ring 202 may be secured to the liner 200 via mechanical fasteners 210, such as screws or bolts. The spacer sleeve 204 functions to space the first and second rotational assemblies 118 and 120 apart at a desired distance. Accordingly, the spacer sleeve 204 may have any suitable or desired axial length 212. Alternatively, the spacer sleeve 204 may be replaced by a ring similar to retaining ring 202 to locate the rotary sleeve 214. The cap 206 functions to direct cement flow from the central passage 105 of the upper portion 104 of the body 100 to the annulus 122 between the body 100 and the canister 102.

Each of the first and second rotational assemblies 118 and 120 includes a rotary sleeve 214 and a door assembly 216. In the illustrated embodiment, the first rotational assembly 118 has a first rotary sleeve 218 and a first door assembly 220, while the second rotational assembly 120 has a second rotary sleeve 222 and a second door assembly 224. When the first and second rotational assemblies 118 and 120 are assembled about the liner 200, the first door assembly 220 is positioned axially above the first rotary sleeve 218, and the second door assembly 224 is positioned axially above the second rotary sleeve 222. Thus, the first rotary sleeve 218 is axially captured by the retaining ring 202 and the first door assembly 220, while the second rotary sleeve 222 is axially captured by the spacer sleeve 204 and the second door assembly 224.

The first and second door assemblies 220 and 224 are rotationally fixed to the liner 200 via mechanical fasteners 226, such as screws or bolts. The first and second rotary sleeves 218 and 222, on the other hand, are not rotationally fixed to the liner 200. In other words, the rotary sleeves 218 and 222 may be rotationally actuated about the liner 200 by the respective actuation mechanism 134 of the rotational assemblies 118 and 120. However, because the retaining ring 202 and the first and second door assemblies 220 and 224 are axially secured to the liner 200, the first and second rotary sleeves 218 and 222 remain in a fixed axial position along the liner 200 relative to the central axis 168 of the plug launching system 56.

Rotation of the first and second rotary sleeves 218 and 222 enables re-direction of cement flow within the plug launching system 56 and launching of one or more plugs 110 contained within the canister 102. First, as mentioned above, rotation of the first and second rotary sleeves 218 and 222 closes the openings of the respective rotational assembly 116 having the rotary sleeve 218 or 222. For example, the first rotary sleeve 218 includes openings 228. When the first rotary sleeve 218 is in an opened position, the openings 228 (e.g., second openings) of the first rotary sleeve 218 are aligned (e.g., circumferentially aligned) with openings 230 (e.g., first openings) formed in the liner 200. Thus, when the first rotary sleeve 218 is in the opened position, cement flowing through the annulus 122 between the body 100 and the canister 102 may flow through the openings 228 and 230 and into the central passage 124 of the plug launching system 56. As mentioned above, the openings 228 and 230 are beneath the first plug 112 supported by the first rotational assembly 118, so the cement flowing through the openings 228 and 230 flows through the annulus 122 and into the central passage 124 while bypassing both plugs 112 and 114 of the plug launching system 56.

When the first rotary sleeve 218 is actuated (e.g., rotated) to the closed position by the actuation mechanism 134, the first rotary sleeve 218 will rotate relative to the liner 200. As a result, the openings 228 and 230 will become rotationally or circumferentially offset from one another, thereby closing the passage between the annulus 122 and the central passage 124 and blocking cement flow therethrough. As discussed above with respect to FIGS. 3 and 4, this actuation re-directs cement flow through the openings 126 of the second rotational assembly 120.

Actuation of the first rotary sleeve 218 also enables axial (e.g., downward) movement of the plug 112 supported by the first rotational assembly 118. When the first rotary sleeve 218 is in a first rotational position (e.g., a opened position), the first rotary sleeve 218 supports doors 232 of the first door assembly 220 such that the doors 232 (e.g., flaps or paddles) extend and are held in a radially inward position (e.g., relative to the central axis 168). When the doors 232 extend radially inward, the doors 232 may support the first plug 112 and/or block axial (e.g., downward) movement of the first plug 112 within the canister 102. The doors 232 are pivotably connected to a main ring 234 of the first door assembly 220. When the first rotary sleeve 218 is actuated (e.g., rotated) to a second rotational position (e.g., a closed position), the first rotary sleeve 218 no longer supports the doors 232 and biases the doors 232 radially inward. Thus, the doors 232 are allowed to fall (e.g., pivot downward). As a result, the first plug 112 may no longer be supported by the doors 232, and the first plug 112 may travel down the plug launching system 56 when sufficient force is applied to the top of the first plug 112 (e.g., via cement flow). Engagement between and operation of the first rotary sleeve 218 and the first door assembly 220 is described in further detail below with respect to FIGS. 7-10.

As will be appreciated, the second rotational assembly 120 has similar features as those described above with respect to the first rotational assembly 118. For example, the second rotary sleeve 222 includes openings 236 (e.g., fourth openings) that align with openings 238 (e.g., third openings) of the liner 200 when the second rotary sleeve 222 is in a first rotational position (e.g., an opened position). In this position, cement may flow through the openings 236 and 238 from the annulus 122 into the central passage 124 of the plug launching system 56. The second door assembly 224 also includes doors 240 (e.g., flaps or paddles) that extend and are held in a radially inward position (e.g., relative to the central axis 168) when the second rotary sleeve 222 is in the first rotational position. When the second rotary sleeve 222 is actuated (e.g., rotated) to a second rotational position (e.g., a closed position), the second rotary sleeve 222 no longer supports the doors 240, and the doors 240 are allowed to fall (e.g., pivot downward) and enable axial movement of the second plug 114.

The liner 200 includes additional features to enable assembly and functionality of the plug launching system 56. For example, the liner 200 includes openings 242 at an axial top 244 of the liner 200. As discussed above with reference to FIG. 5, the openings 242 enable cement to flow from the annulus 122 into the central cavity 124 to launch the second plug 114 when the first and second rotational assemblies 118 and 120 are in the closed positions. The liner 200 also includes openings 246, which enable assembly of the first and second door assemblies 220 and 224. Specifically, when the first and second door assemblies 220 and 224 are positioned about the liner 200 during assembly, the doors 232 and 240 may be pivoted flat against an outer surface 248 of the liner 200. The doors 232 and 240 may be lined up with one of the respective openings 246 and then pivoted radially inward to extend into the central passage 124 of the plug launching system 56.

Figure 7:
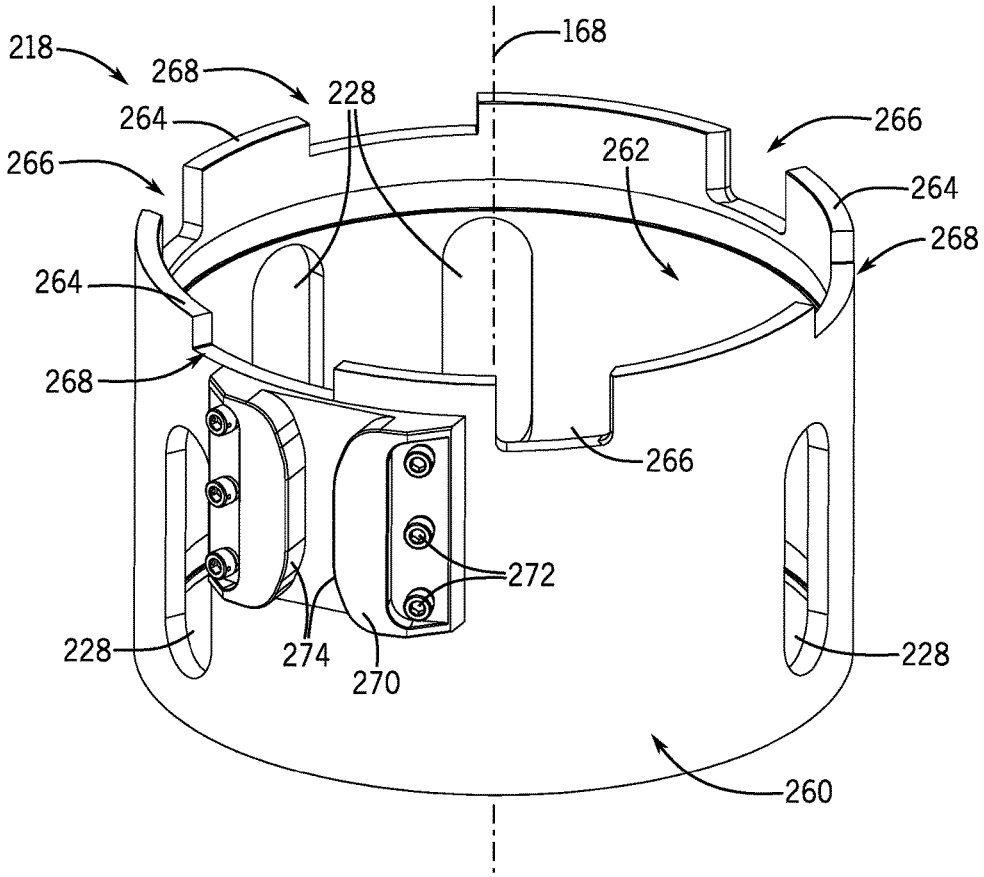
FIG. 7 is a perspective view of an embodiment of a rotary sleeve of a plug launching system, in accordance with present techniques.

FIG. 7 is a perspective view of an embodiment of the first rotary sleeve 218 of the first rotational assembly 118. As described above, the first rotary sleeve 218 includes openings 228 which align with the openings 230 of the liner 200 to enable cement flow therethrough when the first rotary sleeve 218 is in the opened position. As shown, the openings 228 of the first rotary sleeve 218 extend from an outer radial surface 260 to an inner radial surface 262 of the first rotary sleeve 218. Rotation of the first rotary sleeve 218 circumferentially offsets the openings 228 and 230 to block cement flow from the annulus 112 to the central cavity 124 of the plug launching system 56.

The first rotary sleeve 218 also supports the doors 232 of the first door assembly 220 when the first rotary sleeve 218 is in the opened position. More specifically, when the first rotary sleeve 218 is in the opened position, the doors 232 will abut an axial end surface 264 of the first rotary sleeve 218. For example, a respective hinge or base portion of each door 232 may contact the axial end surface, such that the axial end surface biases each door 232 to extend radially inward (e.g., relative to the central axis 168 of the plug launching system 56).

When the first rotary sleeve 218 is actuated (e.g., rotated) via the actuation mechanism 134, the first rotary sleeve 218 rotates relative to the first door assembly 220, which is rotationally fixed relative to the liner 200. Upon full actuation (e.g., rotation) of the first rotary sleeve 218, each of the doors 232 of the first door assembly 220 will circumferentially align with a respective door slot 266 formed in the axial end surface 264 of the first rotary sleeve 218. For example, full actuation (e.g., rotation) of the first rotary sleeve 218 may be after the first rotary sleeve 218 has rotated 10, 15, 20, 25, 30, or more degrees. As will be appreciated, the number of door slots 266 may be equal to the number of doors 232 in the first door assembly 220. Additionally, the door slots 266 may be similarly spaced about a circumference of the first rotary sleeve 218 as the doors 232 are spaced about a circumference of the first door assembly 220 (e.g., the main ring 234 of the first door assembly 220) to enable common alignment of the doors 232 and door slots 266. When the doors 232 and the door slots 266 circumferentially align, the doors 232 will no longer be supported and biased radially inward by the axial end surface 264. Thus, the doors 232 may pivot downward (e.g., fall via gravity), and the first plug 112 that was previously supported and/or blocked by the doors 232 may be free to move axially downward when force is applied to the first plug 112 via cement flow. In this manner, the first plug 112 may be launched from the plug launching system 56 and into the casing string 28.

The first rotary sleeve 218 also includes guide slots 268 formed in the axial end surface 264. As discussed in further detail below with reference to FIG. 8, a respective guide tab of the first door assembly 220 may be disposed within each one of the guide slots 268 to guide and/or limit rotation of the first rotary sleeve 218 relative to the first door assembly 220. For example, the engagement of the guide slots 268 and guide tabs may block over-rotation of the first rotary sleeve 218 relative to the first door assembly 220 and/or indicate to an operator that the first rotary sleeve 218 has been fully actuated to the closed position.

The first rotary sleeve 218 further includes a guide cam 270 coupled to the outer radial surface 260 of the first rotary sleeve 218. The guide cam 270 is a component of the actuation mechanism 134. While the illustrated embodiment shows the guide cam 270 as a separate component coupled to the first rotary sleeve 218 via mechanical fasteners (e.g., bolts) 272, in other embodiments the guide cam 270 may be integrally formed with the first rotary sleeve 218. The guide cam 270 includes curved cam surfaces 274. As described below with reference to FIGS. 9 and 10, the curved cam surfaces 274 enable rotation of the first rotary sleeve 218 upon actuation of the actuation mechanism 134. It will be appreciated that the second rotary sleeve 222 may have similar elements and features as those described above with reference to the first rotary sleeve 218.

Figure 8:
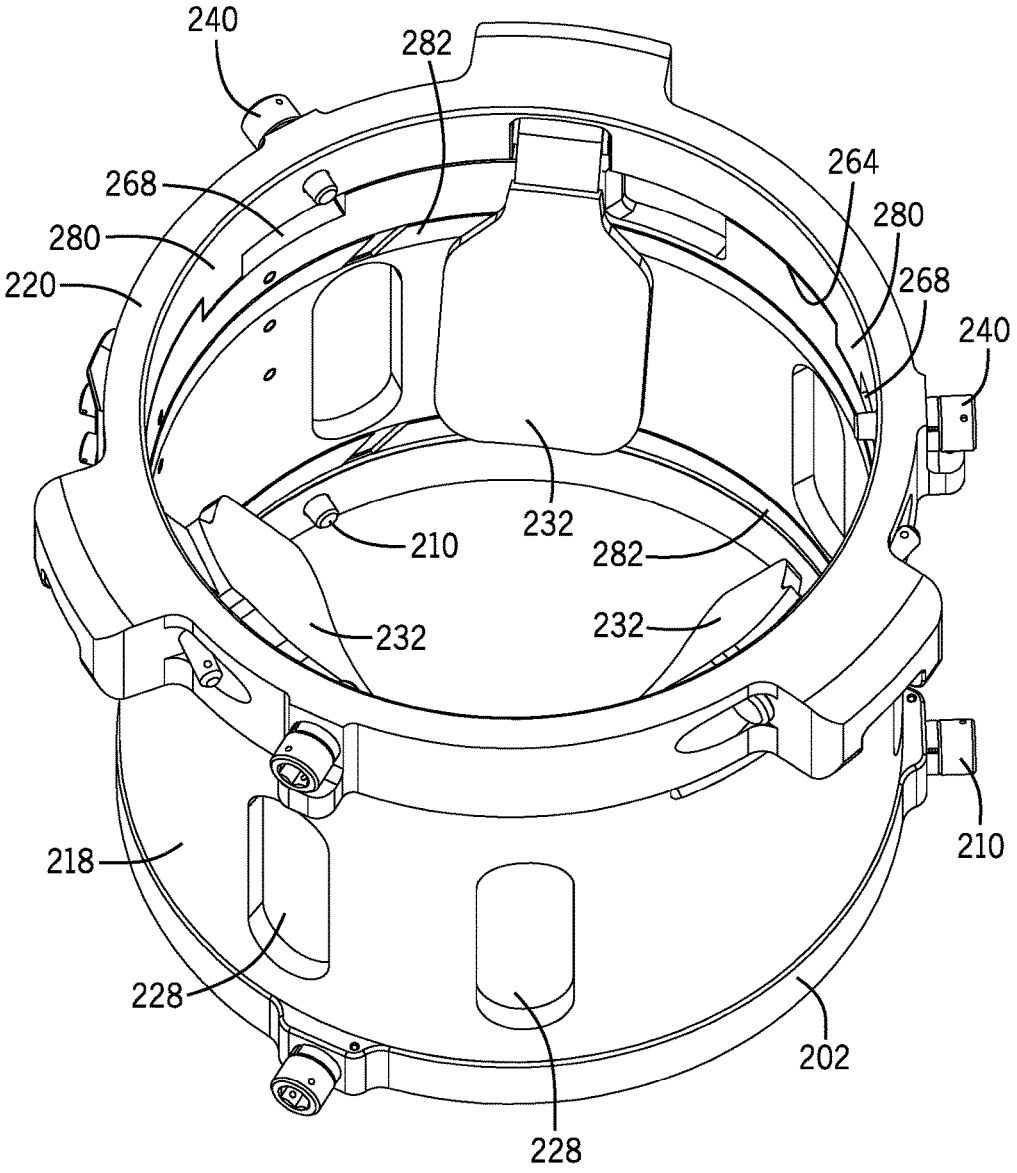
FIG. 8 is a perspective view of an embodiment of a rotary sleeve and a door assembly of a plug launching system, in accordance with present techniques.

FIG. 8 is a perspective view of an embodiment of the first rotational assembly 118, illustrating the first door assembly 220 positioned on top of the first rotary sleeve 218 and the retaining ring 202 positioned beneath the first rotary sleeve 218. In the illustrated embodiment, the first rotational assembly 118 is in the closed position. As such, the doors 232 of the first door assembly 220 abut the axial end surface 264 of the first rotary sleeve 218 and are biased radially inward relative to the central axis 168 of the plug launching system 56. In this position, the first plug 112 is blocked from traveling axially downward through the plug launching system 56.

As mentioned above, the first rotary sleeve 218 includes the guide slots 268 formed in the axial end surface 264. The illustrated embodiment shows guide tabs 280 of the first door assembly 220, each of which is positioned in one of the guide slots 268. Engagement of the guide tabs 280 with the guide slots 268 limits rotation of the first rotary sleeve 218 relative to the first door assembly 220. Thus, an arc length of each guide slot 268 may be selected to achieve a desired limit of rotational movement of the first rotary sleeve 218 relative to the first door assembly 220.

The first rotary sleeve 218 also includes a plurality of bands 282 extending about the inner radial surface 262 of the first rotary sleeve 218. The bands 282 may be a surface treatment, insert, or other feature that reduces friction between the first rotary sleeve 218 and the liner 200 when the first rotational assembly 118 is actuated. For example, the bands 282 may be formed from a bearing material, such as ceramic, steel, or other suitable bearing material. As similarly mentioned above, the second rotational assembly 120 may have similar elements and features as those described above with reference to the first rotational assembly 118.

Figure 9:
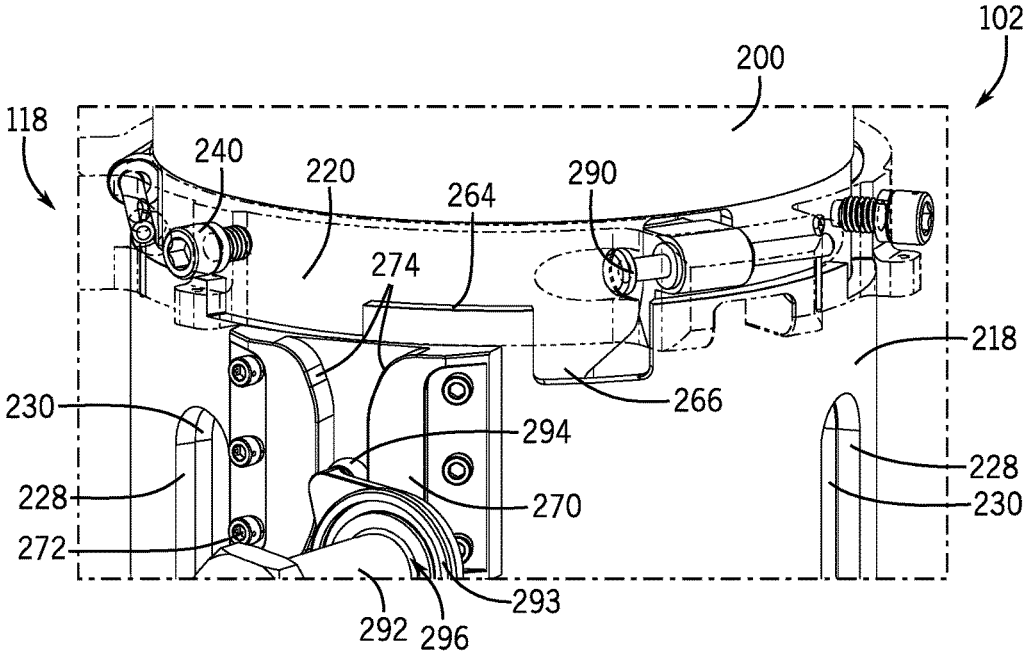
FIG. 9 is a partial perspective view of an embodiment of a plug launching system, in accordance with present techniques.

FIG. 9 is a partial perspective view of the canister 102, illustrating the first rotational assembly 118 assembled on the liner 200. In the illustrated embodiment, the first rotational assembly 118 is in an opened position. Thus, the openings 228 of the first rotary sleeve 218 are circumferentially aligned with the openings 230 of the liner 200 to enable cement flow therethrough. Additionally, the doors 232 of the first door assembly 220 are biased radially inward by the axial end surface 264 of the first rotary sleeve 218. Each of the doors 232 is coupled to the main ring 234 of the first door assembly 220 via a pin 290 (e.g., a hinged connection).

The illustrated embodiment also shows an actuation arm 292 of the actuation mechanism 134. The actuation arm 292 extends through the body 100 of the plug launching system 56 to enable an operator to actuate the actuation mechanism (e.g., via rotation). For example, the actuation arm 292 may be rotated via an automated machine, an electric gear motor, a hydraulic actuation system, a pneumatic actuation system, a hand tool, or other suitable manner. The actuation arm 292 includes a disk 293 having a camming ball 294 disposed at an end 296 of the actuation arm 292. When the actuation arm 292 is rotated by an operator, the disk 293 and the camming ball 294 rotate as well. As the camming ball 294 rotates, it also travels along the curved camming surfaces 274 of the guide cam 270 and transfers the rotational force of the camming ball 294 to the guide cam 270. In this manner, rotation of the actuation arm 292 creates rotational movement of the guide came 270 and the first rotary sleeve 218 to move the first rotary sleeve 218 from the opened position to the closed position.

Figure 10:
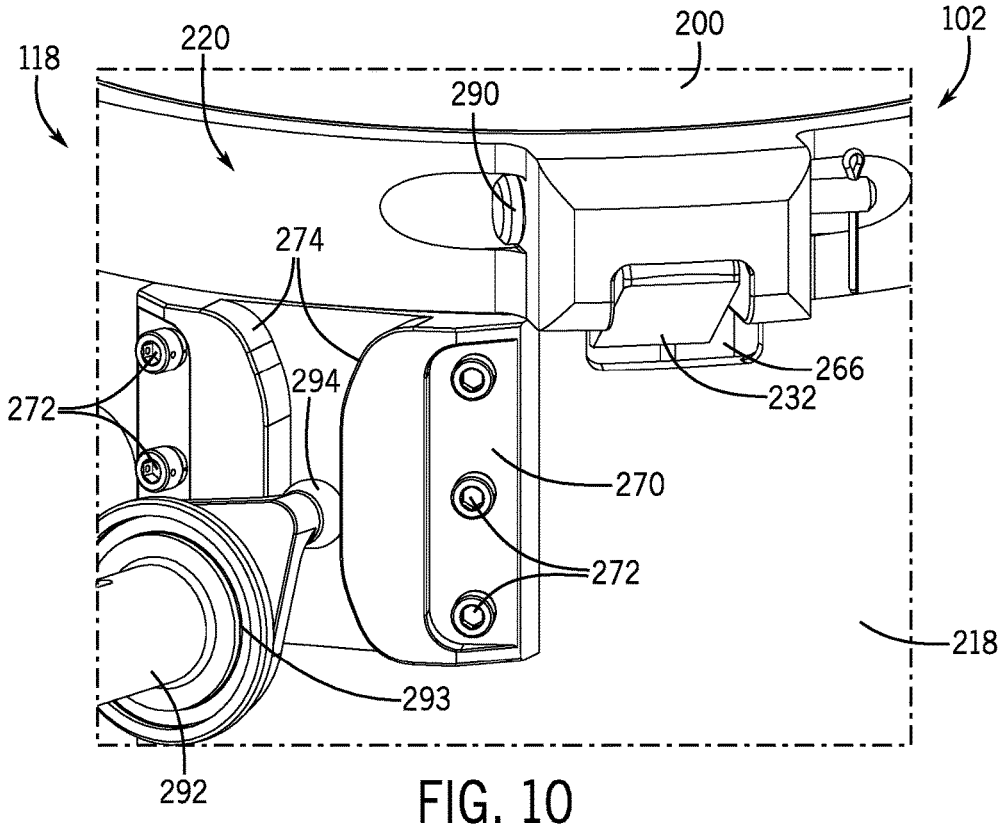
FIG. 10 is a partial perspective view of an embodiment of a plug launching system, in accordance with present techniques.

FIG. 10 is a partial perspective view of the canister 102, illustrating the first rotational assembly 118 assembled on the liner 200. In the illustrated embodiment, the first rotational assembly 118 is in a closed position. Thus, the openings 228 of the first rotary sleeve 218 are circumferentially offset from the openings 230 of the liner 200 to block cement flow therethrough. Additionally, as shown, the doors 232 of the first door assembly 220 are each circumferentially aligned with one of the door slots 266 of the first rotary sleeve 218. As a result, the doors 232 are no longer biased radially inward, and the doors 232 may pivot downward (e.g., via gravity) to enable passage of the first plug 112 through the plug launching system 56 and into the casing string 28 as cement is re-directed into the central passage 124 of the plug launching system 56 above the first plug 112, in the manner described above.

As described in detail above, present embodiments provide a system and method for launching one or more cement plugs or darts 110 within the casing string 28. During casing string 28 cementing operations, the plug (e.g., rubber plug) 110 is used to separate cement from displacement fluid as the plug 110 is launched to substantially remove cement from an interior surface of wellbore tubulars (e.g., casing string 28). In certain embodiments, the plug launching system 56 includes two or more plugs 110 to be individually launched down the casing string 28. As a result, the disclosed plug launching system 56 may be used for multi-stage cementing operations.

Before cement is pumped into the casing string 28, the plug launching system 56 is coupled between the casing string 28 and a cementing process component, such as the cement swivel 50. Cement may then be pumped through the plug launching system 56 into the casing string 28. After a desired amount (e.g., a first stage amount) of cement is pumped into the casing string 28, the plug launching system 56 is actuated to re-direct the cement flow behind the first plug 112 of plug launching system 56 to launch the first plug 112 down the casing string 28. Thereafter, cement may be pumped through the plug launching system 56 again to complete a second stage cementing process. After a desired amount (e.g., a second stage amount) of cement is pumped into the casing string 28, the plug launching system 56 is actuated to re-direct the cement flow behind the second plug 114 of plug launching system 56 to launch the second plug 114 down the casing string 28. Although the embodiments of the plug launching system 56 described above include two plug 110 stages, other embodiments may include one, three, four, five, or more plug 110 stages using techniques similar to those described above.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A plug launching system, comprising:
a main body; and
a plug canister disposed within the main body, wherein the plug canister comprises:
a liner;
a first rotational assembly disposed about the liner and comprising a first rotary sleeve coupled with a first door assembly, wherein the first door assembly is configured to support a first plug disposed within the liner and wherein the rotary sleeve is configured to selectively enable fluid flow from an annulus between the main body and the plug canister to a central passage of the liner; and
a second rotational assembly disposed about the liner, wherein the second rotational assembly is configured to support a second plug disposed within the liner and selectively enable fluid flow from the annulus between the main body and the plug canister to the central passage of the liner, wherein the first and second rotational assemblies are configured to be actuated independently from one another.

2. The plug launching system of claim 1, wherein the first rotary sleeve is rotatable relative to the liner, the first door assembly is rotationally fixed to the liner, and the first door assembly is axially above the first rotary sleeve when the plug canister is disposed within the main body.

3. The plug launching system of claim 2, wherein the liner comprises a first plurality of openings, and the first rotary sleeve comprises a second plurality of openings, wherein the first plurality of openings and the second plurality of openings are circumferentially aligned relative to a central axis of the plug launching system when the first rotary sleeve is in a first rotational position, and the first plurality of openings and the second plurality of openings are circumferentially offset relative to the central axis of the plug launching system when the first rotary sleeve is in a second rotational position.

4. The plug launching system of claim 3, comprising the first plug, wherein the first plurality of openings and the second plurality of openings are disposed axially below the first plug when the first plug is disposed within the plug canister and the plug canister is disposed within the main body.

5. The plug launching system of claim 2, wherein the first door assembly comprises a main ring and a plurality of doors pivotably coupled to the main ring, wherein each door of the plurality of doors is configured to extend radially inward into the central passage of the liner.

6. The plug launching system of claim 5, wherein the first rotary sleeve comprises an axial end surface, wherein the axial end surface is configured to contact each door of the plurality of doors to bias each door of the plurality of doors radially inward into the central passage of the liner when the first rotary sleeve is in a first rotational position.

7. The plug launching system of claim 6, wherein the first rotary sleeve comprises a plurality of door slots formed in the axial end surface, wherein each door slot of the plurality of door slots is configured to circumferentially align with one of the doors of the plurality of doors when the first rotary sleeve is in a second rotational position.

8. The plug launching system of claim 2, wherein the second rotational assembly comprises a second rotary sleeve and a second door assembly, the second rotary sleeve is rotatable relative to the liner, the second door assembly is rotationally fixed to the liner, the second door assembly and the second rotary sleeve are axially above the first door assembly and the first rotary sleeve and the second door assembly is axially above the second rotary sleeve when the plug canister is disposed within the main body.

9. The plug launching system of claim 8, wherein the liner comprises a third plurality of openings, and the second rotary sleeve comprises a fourth plurality of openings, wherein the third plurality of openings and the fourth plurality of openings are circumferentially aligned relative to the central axis of the plug launching system when the second rotary sleeve is in a third rotational position, the third plurality of openings and the fourth plurality of openings are circumferentially offset relative to the central axis of the plug launching system when the second rotary sleeve is in a fourth rotational position, and the third plurality of openings and the fourth plurality of openings are disposed axially below the second plug and axially above the first plug when the first plug and the second plug are disposed within the plug canister and the plug canister is disposed within the main body.

10. The plug launching system of claim 1, wherein the plug launching system comprises a baffle plate disposed between the plug canister and the main body at an axial end of the annulus to block fluid flow through the axial end of the annulus.

11. The plug launching system of claim 1, wherein the main body comprises an upper portion and a lower portion, wherein the lower portion is configured to couple to a tubular string, and the upper portion is configured to couple to a cementing process component.

12. A method, comprising:

directing a cement flow through an annulus between a plug canister and a main body of a plug launching system;

directing the cement flow from the annulus to a central passage of the plug canister through a first plurality of openings extending through the plug canister, wherein the first plurality of openings are disposed axially below a first plug disposed within the plug canister;

directing the cement flow from the central passage into a casing string disposed within a wellbore;

rotating a first rotary sleeve of the plug canister about a central axis of the plug canister to occlude the first plurality of openings; and re-directing the cement flow from the annulus to the central passage of the plug canister through a second plurality of openings extending through the plug canister, wherein the second plurality of openings are disposed axially above the first plug.

13. The method of claim 12, wherein rotating the first rotary sleeve of the plug canister comprises circumferentially aligning a first plurality of pivotable doors extending radially inward into the central passage with a first plurality of door slots formed in the first rotary sleeve, wherein the first plurality of pivotable doors is disposed axially below the first plug prior to rotating the first rotary sleeve.

14. The method of claim 12, comprising:

launching the first plug down the casing string with the cement flow;

directing the cement flow from the central passage into the casing string after launching the first plug down the casing string with the cement flow;

rotating a second rotary sleeve of the plug canister to occlude the second plurality of openings; and re-directing the cement flow from the annulus to the central passage of the plug canister through a third plurality of openings extending through the plug canister, wherein the third plurality of openings are disposed axially above the second plug; and launching the second plug down the casing string with the cement flow.

15. The method of claim 12, wherein rotating the second rotary sleeve of the plug canister comprises circumferentially aligning a second plurality of pivotable doors extending radially inward into the central passage with a second plurality of door slots formed in the second rotary sleeve, wherein the second plurality of pivotable doors is disposed axially below the second plug prior to rotating the second rotary sleeve.

16. The method of claim 12, wherein rotating the first rotary sleeve of the plug canister to occlude the first plurality of openings comprises rotating an actuation arm to guide a camming ball along a curved camming surface coupled to the first rotary sleeve, wherein the actuation arm extends from the annulus through the main body of the plug launching system.

17. A plug launching system, comprising:

a plug canister, comprising:

a liner comprising a first plurality of openings and a second plurality of openings;

a first rotary sleeve disposed about the liner, wherein the first rotary sleeve is configured selectively enable fluid flow through the first plurality of openings to a central passage of the liner;

a first door assembly disposed adjacent to the first rotary sleeve, wherein the first door assembly comprises a first plurality of doors pivotably coupled to a first main ring of the first door assembly;

a second rotary sleeve disposed about the liner, wherein the second rotary sleeve is configured selectively enable fluid flow through the second plurality of openings to the central passage of the liner; and a second door assembly disposed adjacent to the second rotary sleeve, wherein the second door assembly comprises a second plurality of doors pivotably coupled to a second main ring of the second door assembly;

wherein the first rotary sleeve and the second rotary sleeve are each rotatable relative to the liner, and wherein the first main ring of the first door assembly and the second main ring of the second door assembly are rotationally fixed relative to the liner.

18. The plug launching system of claim 17, wherein the first rotary sleeve comprises a third plurality of openings, wherein the first plurality of openings and the third plurality of openings are circumferentially aligned relative to a central axis of the plug launching system when the first rotary sleeve is in a first rotational position, and the first plurality of openings and the third plurality of openings are circumferentially offset relative to the central axis of the plug launching system when the first rotary sleeve is in a second rotational position, and wherein the second rotary sleeve comprises a fourth plurality of openings, wherein the second plurality of openings and the fourth plurality of openings are circumferentially aligned relative to the central axis of the plug launching system when the second rotary sleeve is in a third rotational position, the second plurality of openings and the fourth plurality of openings are circumferentially offset relative to the central axis of the plug launching system when the second rotary sleeve is in a fourth rotational position.

19. The plug launching system of claim 17, wherein the first rotary sleeve comprises a first axial end surface and a first plurality of door slots formed in the first axial end surface, wherein each door of the first plurality of doors is circumferentially aligned with the first axial end surface when the first rotary sleeve is in a first rotational position, and wherein each door slot of the first plurality of door slots is circumferentially aligned with one of the doors of the first plurality of doors when the first rotary sleeve is in a second rotational position.

20. The system of claim 19, wherein the first rotational position and the second rotational position are between 15 and 20 degrees apart from one another.

* * * * *